US007347148B2

(12) United States Patent
Roth et al.

(10) Patent No.: US 7,347,148 B2
(45) Date of Patent: Mar. 25, 2008

(54) SHIPPING PALLET EQUIPPED WITH A NON-STRUCTURAL MEMBER CARRYING A READABLE DEVICE

(75) Inventors: Arthur J. Roth, Orinda, CA (US); Anthony F. Drake, Antioch, CA (US)

(73) Assignee: Hunter Paine Enterprises, LLC, Pittsburg, CA (US)

( * ) Notice: Subject to any disclaimer, the term of this patent is extended or adjusted under 35 U.S.C. 154(b) by 93 days.

(21) Appl. No.: 11/214,350

(22) Filed: Aug. 30, 2005

(65) Prior Publication Data

US 2006/0254474 A1 Nov. 16, 2006

Related U.S. Application Data

(60) Provisional application No. 60/679,661, filed on May 11, 2005.

(51) Int. Cl.
*B65D 19/00* (2006.01)

(52) U.S. Cl. ..... 108/51.11; 340/572.1

(58) Field of Classification Search ..... 108/51.11, 108/57.25; 340/572.1, 572.7, 572.8, 933, 340/825.17; 238/385, 384
See application file for complete search history.

(56) References Cited

U.S. PATENT DOCUMENTS

| | | | | |
|---|---|---|---|---|
| 5,440,300 | A | 8/1995 | Spillman, Jr. | 340/825.54 |
| 5,648,765 | A * | 7/1997 | Cresap et al. | 340/10.4 |
| 5,708,419 | A | 1/1998 | Isaacson et al. | 340/572 |
| 5,959,568 | A | 9/1999 | Woolley | 342/42 |
| 5,973,599 | A | 10/1999 | Nicholson et al. | 340/572.8 |
| 6,214,155 | B1 | 4/2001 | Leighton | 156/298 |
| 6,249,227 | B1 | 6/2001 | Brady et al. | 340/572.1 |
| 6,335,685 | B1 | 1/2002 | Schrott et al. | 340/572.1 |
| 6,352,039 | B1 * | 3/2002 | Woods et al. | 108/57.25 |
| 6,388,630 | B1 | 5/2002 | Kruger et al. | 343/767 |
| 6,441,740 | B1 | 8/2002 | Brady et al. | 340/572.7 |
| 6,483,434 | B1 * | 11/2002 | UmiKer | 340/572.1 |
| 6,488,212 | B1 | 12/2002 | Maeder | 235/494 |
| 6,492,904 | B2 | 12/2002 | Richards | 340/539 |

(Continued)

FOREIGN PATENT DOCUMENTS

JP 05085545 A * 4/1993

OTHER PUBLICATIONS

New Release: "Wal-Mart Begins Roll-Out of Electronic Product Codes in Dallas/Fort Worth Area" (Apr. 30, 2004).

(Continued)

*Primary Examiner*—Jose V. Chen
(74) *Attorney, Agent, or Firm*—Fitzpatrick, Cella, Harper & Scinto

(57) ABSTRACT

A shipping pallet comprised of at least one layer of substantially parallel, structural deck boards attached to a plurality of stringers is disclosed. The layer of deck boards defines a three-dimensional, substantially rectilinear deck zone that is defined by a top plane, a bottom plane, and four side-edge planes. The pallet includes at least one non-structural member that carries a readable device within the deck zone of a pallet, in the space between two structural deck boards. The non-structural member has a Modulus of Elasticity and Modulus of Rupture that are both below that of the strongest deck board in the deck zone in which the non-structural member is mounted.

15 Claims, 10 Drawing Sheets

U.S. PATENT DOCUMENTS

| | | | | |
|---|---|---|---|---|
| 6,529,127 | B2 | 3/2003 | Townsend et al. | 340/505 |
| 6,563,417 | B1 | 5/2003 | Shaw | 340/10.1 |
| 6,600,418 | B2 | 7/2003 | Francis et al. | 340/572.1 |
| 6,621,410 | B1 | 9/2003 | Lastinger et al. | 340/10.42 |
| 6,669,089 | B2 | 12/2003 | Cybulski et al. | 235/385 |
| 6,814,287 | B1 | 11/2004 | Chang et al. | 235/451 |
| 6,866,752 | B2 | 3/2005 | Schramm | 204/192.38 |
| 7,155,304 | B1 * | 12/2006 | Charych | 700/214 |
| 2002/0030597 | A1 | 3/2002 | Muirhead | 340/572.1 |
| 2002/0126013 | A1 | 9/2002 | Bridgelall | 340/572.1 |
| 2002/0130778 | A1 | 9/2002 | Nicholson | 340/572.1 |
| 2002/0185532 | A1 | 12/2002 | Berquist et al. | 235/385 |
| 2002/0190862 | A1 | 12/2002 | Berquist et al. | 340/572.1 |
| 2003/0001726 | A1 | 1/2003 | Moore | 340/10.3 |
| 2003/0052776 | A1 | 3/2003 | Richards | 340/539 |
| 2003/0090388 | A1 | 5/2003 | Pomes | 340/825.49 |
| 2003/0108700 | A1 | 6/2003 | Krech et al. | 428/35.7 |
| 2003/0112143 | A1 | 6/2003 | Serra | 340/572.7 |
| 2003/0132853 | A1 | 7/2003 | Ebert | 340/825.49 |
| 2003/0156033 | A1 | 8/2003 | Savage et al. | 340/572.8 |
| 2003/0179092 | A1 | 9/2003 | Loftus et al. | 340/572.7 |

OTHER PUBLICATIONS

Hunter Paine Enterprises, LLC, "Hunter Paine and Savi Combine Technologies to Create the Leading Edge RFID Smart Pallet" (Mar. 2004).

* cited by examiner

SHIPPING PALLET EQUIPPED WITH A NON-STRUCTURAL MEMBER CARRYING A READABLE DEVICE

RELATED APPLICATION

This application claims the benefit of U.S. Provisional Patent Application No. 60/679,661, filed on May 11, 2005.

BACKGROUND OF THE INVENTION

This invention relates to shipping pallets equipped with one or more readable devices, such as, for example, radio frequency identification (RFID) tags, microprocessors, sensors, and the like. More specifically, it relates to those of such pallets that have a deck-boards-and-stringers or deck-boards-and-stringer-and-blocks type of construction wherein the deck boards do not cover the entire load-bearing surface of the pallet. Pallets utilizing this type of construction usually are made of wood or structural plastic and typically include but are not limited to: stringer pallets, two-way stringer pallets, modified four-way stringer pallets, heavy duty stringer pallets notched for four-way entry, stevedore type double wing pallets, stevedore type single wing pallets, single faced skids, grocery industry four-way pallets, limited use stringer pallets, block pallets, perimeter base block pallets, and standard reversible pallets, but do not include panel deck pallets or full deck pallets.

A problem in equipping a shipping pallet or skid of the deck board type construction with a readable device, such as an RFID tag, is where and how to attach or enclose the device so that it is not exposed to lifting-fork impact or subjected to the load borne by the pallet. U.S. Pat. No. 6,814,287 to Chang et al. suggests placing the RFID tag in a deep, cylindrical cavity in one of the stringers, enclosed in a sealed housing that is friction-held in the cavity. One drawback of that arrangement is that the removal of so much material from the stringer weakens it. Another drawback is that the tag is practically surrounded by a wall of wood or man-made material that is so thick that it can be a serious barrier to RF transmission between the tag and an RFID-interrogation device used to "read" information stored on the tag. Wood used in shipping pallets typically has a moisture content of ±11%. The moisture content presents a significant barrier to RF transmission between the tag and the RFID-interrogation device. If the moisture content is reduced through heating, the wood becomes brittle and subject to splintering, possibly rendering the shipping pallet useless.

U.S. Pat. No. 6,669,089 to Cybulski et al. suggests placing the RFID tag in or on one of the deck boards or, alternatively, on a chamfered inside corner of one of four corner blocks used to support flat-lying stringer boards that underlay the top deck boards. As for the attachment of the tag to the surface of a deck board or corner block, because of the extremely rugged treatment a shipping pallet can receive, that still exposes the tag to forces that can damage or dislodge it, even if it is located between two deck boards or on the inside edge of a corner block. Debris from above can be forced down between the deck boards by the weight of a load on the pallet, possibly causing harmful impact or pressure on any tag attached to the vertical inside edge of a deck board. If mounted on the inside chamfered edge of a corner block, the tag may not be as exposed to down-forced debris, but it is still somewhat vulnerable to dislodgement or breakage by misdirected forklift tines. Additionally, the wooden block presents a serious barrier to RF transmission between the tag and any RFID-interrogation device used to "read" information stored on the tag.

As for placing the RFID tag inside one of the deck boards, the cavity required weakens the board. Moreover, if the board is plastic it can be difficult and costly to choose a type of RFID tag that will withstand the thermoforming temperatures required to mold the board with the tag inside. A cavity could be milled out of the plastic board later, but that operation adds to the cost of manufacture as well.

SUMMARY OF THE INVENTION

The present invention addresses these problems by mounting a non-structural member that carries a readable device within the deck zone of a pallet, in the space between two structural deck boards. The non-structural member serves to protect the readable device from being damaged during the normal use of the pallet.

The readable device can be any device that is capable of collecting and/or storing information for retrieval at a later time. Examples of readable devices include active and passive RFID tags, microprocessors, temperature sensors, humidity sensors, moisture sensors, radiation sensors, shock sensors, and the like.

The non-structural member preferably is made of such a material, and/or has a thin enough wall construction, that the non-structural member is suitably permeable to RF transmission, particularly if the readable device is an RFID tag. Thus, transmission between the RFID tag and an external RFID-interrogation device generally will be better than if the tag were buried inside one of the structural deck boards.

By a pallet having a deck-boards-and-stringers type construction is meant any pallet having a layer of parallel deck boards that are fastened to two or more underlying boards that run in a direction perpendicular to the deck boards. Generally, each of the deck boards has a cross-sectional area of at least about 14.5 $cm^2$, e.g., in the range of about 14.5 to 41.9 $cm^2$. The stringer boards may in turn be fastened to blocks, in the case of a block pallet. The underlying boards can either be set on edge or can be laid flat, e.g., atop corner blocks. Whether set on edge or laid flat, in this specification we refer to all such boards as "stringers." The deck boards and stringers can be made of wood or any suitable substitute for wood, e.g., of synthetic resin or a composite material. Usually they are solid. As examples of wood substitutes that are structural composites may be mentioned those disclosed in U.S. Provisional Patent Application Ser. No. 60/639,804 by Roth et al., the specification and drawings of which are hereby incorporated herein by reference.

By "non-structural" we mean that the member's Modulus of Elasticity (MOE) and Modulus of Rupture (MOR) are both below that of the strongest deck board in the deck zone in which the non-structural member is located. The MOE and MOR of pallet deck boards typically fall within the following ranges:

| Type of Board | MOE (psi) | MOR (psi) |
|---|---|---|
| Hardwood | 800,000-1,300,000 | 4,000-5,500 |
| Plastic | 175,000-450,000 | 1,500-3,500 |
| Roth et al. Composite | 700,000-1,000,000 | 4,500-7,000 |

Preferably the non-structural member of the present invention will have an MOE of about 1,000 to 115,000 psi and an MOR of about 50 to 1,450 psi.

The dimensions of the non-structural member are such that it is substantially entirely contained within the deck zone—i.e., the non-structural member does not protrude any significant distance above or below the deck boards; nor does it extend any significant distance beyond either end of the deck boards. In this manner the non-structural member (and the readable device carried by it) is reasonably well protected against any impact by forklift tines. By "deck zone" is meant that three-dimensional, substantially rectilinear zone that is defined by a layer of deck boards, be it on the top or bottom of the pallet. The deck zone has a top plane (the upper surface of the deck boards), a bottom plane (the under surface of the deck boards), and four side-edge planes.

The non-structural member preferably is elongated in shape and preferably is mounted substantially parallel to the two structural deck boards that flank the member. It is also preferred that the non-structural member be of a sufficient length that it spans at least two stringers. Most preferably the non-structural member is substantially rectilinear, is either substantially the same length as the structural deck boards or approximately half their length, and is attached to at least two stringers. If the non-structural member is the same length as the structural deck boards and the pallet has more than two stringers, preferably the non-structural member is attached to at least the two outermost stringers.

Because the non-structural member's principal purpose is not to add strength to the pallet, it can be made light in weight without compromising its performance. And the lower the non-structural member's gross density, the less weight it will add to the pallet. Therefore, it is preferred that the non-structural member have a gross density that is lower than that of the lowest-density structural board in that same deck zone. Thus, for example, the non-structural member can be made of plastic, e.g., a thermosetting resin or a thermoplastic resin. Examples of thermosetting resins believed to be suitable include epoxy resins, urea-formaldehyde resins, melamine-formaldehyde resins, phenol-formaldehyde resins, polyester resins, vinyl ester resins, and polyurethane resins (both polyether-polyurethanes and polyester-polyurethanes). When a polyurethane resin is used, preferably it will have a density of at least about 50 pounds per cubic foot.

Examples of thermoplastic resins believed to be suitable include polyvinyl chlorides, polystyrene, polyolefins, polyamides, polyesters, and acrylate resins (e.g., cyanoacrylate resins).

Most preferably, the non-structural member is made of a high-impact, UV-resistant resin. For example, it may be made of acrylonitrile-styrene-butadiene (ABS) resin, e.g., general-purpose ABS resin such as General Purpose SP-900 ABS from Port Plastics, of Los Angeles, Calif. Another suitable type of high-impact resin is high-density polyethylene (HDPE) resin, e.g., the Polystone G HDPE resin produced by Port Plastics.

To minimize its weight, preferably the non-structural member is hollow if its thickness is anywhere close to that of the structural deck boards, which are typically about 1.6 cm thick. The cross section of the hollow member can be closed, such as a rectangular sleeve, or open, such as a C-shaped channel. Alternatively, the weight of the non-structural member can be kept down by making it substantially solid, but with a much smaller cross-sectional area than the structural deck boards, e.g., with a cross-sectional area of only about 0.4 to 6 $cm^2$. Thus, for example, if the non-structural member is solid, it might have a width of about 2 to 5 cm and a thickness of about 0.2 to 1.2 cm.

If the non-structural member is hollow, the readable device preferably will be held stationary inside the member. That can be accomplished, for example, by dimensioning the readable device such that it is held in place by friction. Alternatively, a clip or other fastening device can be used, the readable device can be held in place by an adhesive, or the readable device can be inlaid directly onto the non-structural member itself. Also, if the non-structural member is a closed sleeve, the cavity inside the sleeve can be substantially filled with some material that is less costly and/or less dense than that of which the walls of the non-structural member are constructed, and which serves to hold the readable device in place. Thus, whereas the walls of the non-structural member might be made out of, say, polyethylene or polypropylene, the cavity inside might be filled with expanded polystyrene beads that surround the readable device and help restrain it from shifting about in the non-structural member when the pallet is moved.

When the non-structural member is hollow, for ease of assembly of the pallet each end of the member can be plugged with a substantially rigid material that reinforces the member. This can facilitate the attachment of the non-structural member to the outermost stringers by use of fasteners (e.g., nails or screws) that pass through the plugs. As suitable plug material may be mentioned, for example, wood, rigid plastic that is foamed or unfoamed, rubber, and blends of two or more of the foregoing. Where plastic is used, it can be undiluted or it can be extended with a suitable filler, e.g., any of the filler solids disclosed in the specification of the aforementioned U.S. Provisional Patent Application Ser. No. 60/639,804. Polyvinyl chloride (PVC) resin, which is relatively economical, is an example of a suitable plastic to use for the plug material—e.g., PVC Rod Type I or Type II from the aforementioned Port Plastics.

The plugs can be separate additions to the non-structural member or they can be integral with the member—e.g., they can be solid zones that are created during a molding operation in which the otherwise hollow sleeve or C-shaped channel is formed.

Each plug extends only part way into the non-structural member, but preferably it extends sufficiently far that it reaches all the way across an underlying stringer on each end of the member. In this way the non-structural member can be attached to two stringers by nail-driving equipment or the like, the same as the structural deck boards are. The presence of the reinforcing plugs can help prevent the non-structural member from bending and/or breaking in response to the nail-pounding blows used to attach the member to the stringers.

If end plugs are used, they can optionally be used in combination with other material (as mentioned above) that substantially fills the cavity between the plugs. To save cost and weight, that filler material can have a lower compression resistance than does the plug material.

When the non-structural member is hollow, in addition to end plugs it may also contain one or more plugs intermediate its length that are in registry with one or more interior stringers in the pallet. In this way the non-structural member easily can be fastened to one or more interior stringers as well, to help hold the member within the deck zone. If the non-structural member has a closed configuration, each interior plug can be inserted and rammed into position from an open end of the member, before that end is plugged.

In the case of some readable devices, especially RFID tags, it is common for pallets to contain a plurality of such tags so as to improve the chances that at least one RFID tag will be read when the pallet is passing through an RFID-interrogation portal or being transported on a forklift that is equipped with a reader device. In view of this, the pallet of the present invention can have, say, two or more spaced-apart RFID tags in the same non-structural member. Also, or instead, a plurality of non-structural members can be used on a single pallet. There can be, for example, one or two non-structural members in a top deck zone and, if there is a bottom deck zone, one or two non-structural members in that zone as well. The number of readable devices incorporated in a pallet can vary widely, from as few as one to more than eight, depending on the type of readable device used.

It might be advantageous to manufacture the non-structural member in two halves, fasten the readable device or devices in place inside one of the halves, and then cement or fuse the two halves together.

Alternatively, the non-structural member can be made of one sleeve-like piece, e.g., by plastic extrusion, and then the readable device or devices can be inserted through the open end or ends of the sleeve. To facilitate insertion of the readable device or devices, it or they can be fastened inside a drawer member (e.g., with an adhesive) and that drawer member can then be slid into the sleeve-like non-structural member. Either or both ends of the drawer members can be fitted with an end plug, to facilitate nailing, stapling, or screwing the housing to underlying stringers.

Another alternative is to mold the non-structural member as a C-shaped channel, and to fasten the readable device to the bottom of the inside of the channel. A thin plastic shield can be secured over the readable device to protect it from moisture and accidental contact. For added protection, it may also be desirable to include end plugs, as described above, and to attach a cover over the open end of the C-shaped channel, thereby creating a closed configuration. This closed configuration is particularly advantageous when the non-structural member is to carry multiple passive or active RFID tags, antennae, batteries, and the like. The enclosed cavity (created by the C-shaped channel, the end plugs, and the cover) provides a housing for potentially sensitive electronics and circuit boards that may be too bulky to be adequately protected by a simple plastic shield on the bottom of the channel.

The non-structural member also can be a substantially non-hollow part having a slot or the like therein to receive and hold each readable device. Thus, for example, the non-structural member can be a solid length of plastic with a linear slot in one of its long-side edges, wide enough and deep enough to hold, and substantially completely envelop, the readable device. The readable device can be held in the slot by a suitable adhesive, e.g., a sealant that closes the slot opening and covers the device, either along the entire length of the slot or just in the segment where the device is located. Alternatively, the readable device can be mechanically held in place in the slot, e.g., by a clip member or a friction fit.

Still another alternative is to form the non-structural member as a thin strip of material, which can be metallic or non-metallic. As regards non-metallic materials, it is contemplated that, for example, plastics, ceramics, glass, paper, or wood (e.g., balsa) can be used. Preferably, it will be plastic (e.g., polyvinyl chloride) having a thickness of about 0.238 to 1.2 cm and a width of about 1.9 to 5.1 cm. One or more readable devices can either be prefabricated and attached to the strip or be formed directly on the strip material, for example by using any of a number of known inlay techniques. An example of one such technique that is believed to be particularly suitable for depositing RFID tags onto a wide variety of substrates is described in U.S. Pat. No. 6,866,752, the disclosure of which is hereby incorporated herein by reference. For added protection against damage and moisture, a plastic shield can be secured over the area where the readable device is inlaid.

Pallets constructed of deck boards and stringers normally have gaps between the deck boards. Depending on the intended strength (i.e., design load capacity) of the pallet, these gaps often range in width anywhere from about 2 cm to about 18 cm. According to the current technology, the dimensions of an RFID tag suitable for use on a shipping pallet usually will include a width of at least about 1.25 cm. (We use the term "width" in the sense that the tag has a length, a width, and a thickness.) According to our understanding, 1.25 cm currently is about the minimum width required of the tag's antenna plane in order to allow good reception of interrogating radio waves. The thickness of structural deck boards often is about 1.6 cm. This may mean that the tag will have to lay substantially flat in the gap between the adjacent deck boards, rather than stand on edge. When the tag is in a flat-laying configuration, the gap might have to be at least 1.9 cm wide in order to accommodate the housing that protects the tag. To accommodate a flat-laying RFID tag but not require the adjacent deck boards to be spread so far apart as to create an unacceptably weak zone in the deck, preferably the non-structural member will have a width of about 1.9 to 5.1 cm. To save materials, however, it is preferred to keep the non-structural member as narrow as possible. Usually that will mean that it will have a width of about 4 cm or less. Thus, the gap between the deck boards that flank the non-structural member, in the pallet of the present invention, often will be about 1.9 to 4 or 5.1 cm wide.

If the design load capacity of the pallet is so high that the standard gap between the deck boards for a pallet of that capacity would not be wide enough to accommodate the non-structural member, then a relatively wide gap can be used between just those deck boards that bracket each non-structural member, while narrower gaps are used between all the other deck boards.

If a single deck zone contains multiple non-structural members, each one preferably will be separated from the others by at least one interior deck boards—most preferably by at least three interior deck boards.

BRIEF DESCRIPTION OF THE DRAWINGS

The invention perhaps will be better understood by reference to the drawings that accompany this specification.

DETAILED DESCRIPTION OF THE PREFERRED EMBODIMENTS

Figure 1:
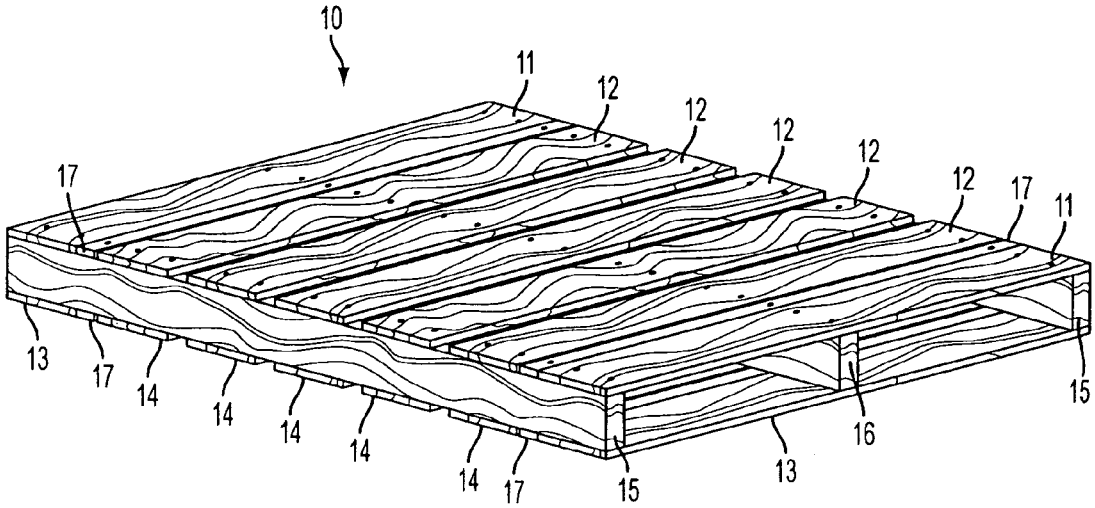
FIGS. 1 and 2 depict wooden shipping pallets made according to preferred embodiments of the present invention.
Figure 2:
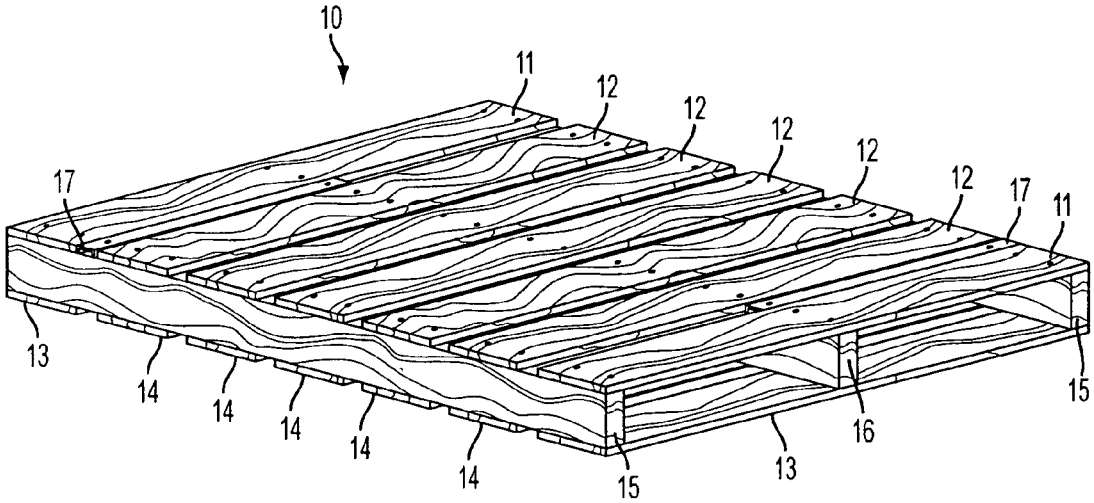

As shown in FIGS. 1 and 2, each pallet 10 is comprised of upper deck boards 11 and 12, lower deck boards 13 and 14, outside stringers 15, and one interior stringer 16. In these particular embodiments all those boards are wooden.

Referring to the upper deck of the pallet 10 shown in FIG. 1, between each front-edge deck board 11 and the next-adjacent interior deck board 12, a non-structural member 17 holding two readable devices, in this case RFID tags, is attached by nails to outside stringers 15 and inside stringer 16. In the lower deck, two identical non-structural members 17 are nailed to the underside of stringers 15 and 16, in between front-edge deck boards 13 and the next-adjacent interior deck boards 14. Non-structural member 17 is a long sleeve-like structure, enclosed at one end. In this particular embodiment each non-structural member measures 102 cm×0.625 cm×4 cm and has walls that are about 1 to 2 mm thick.

Figure 3:
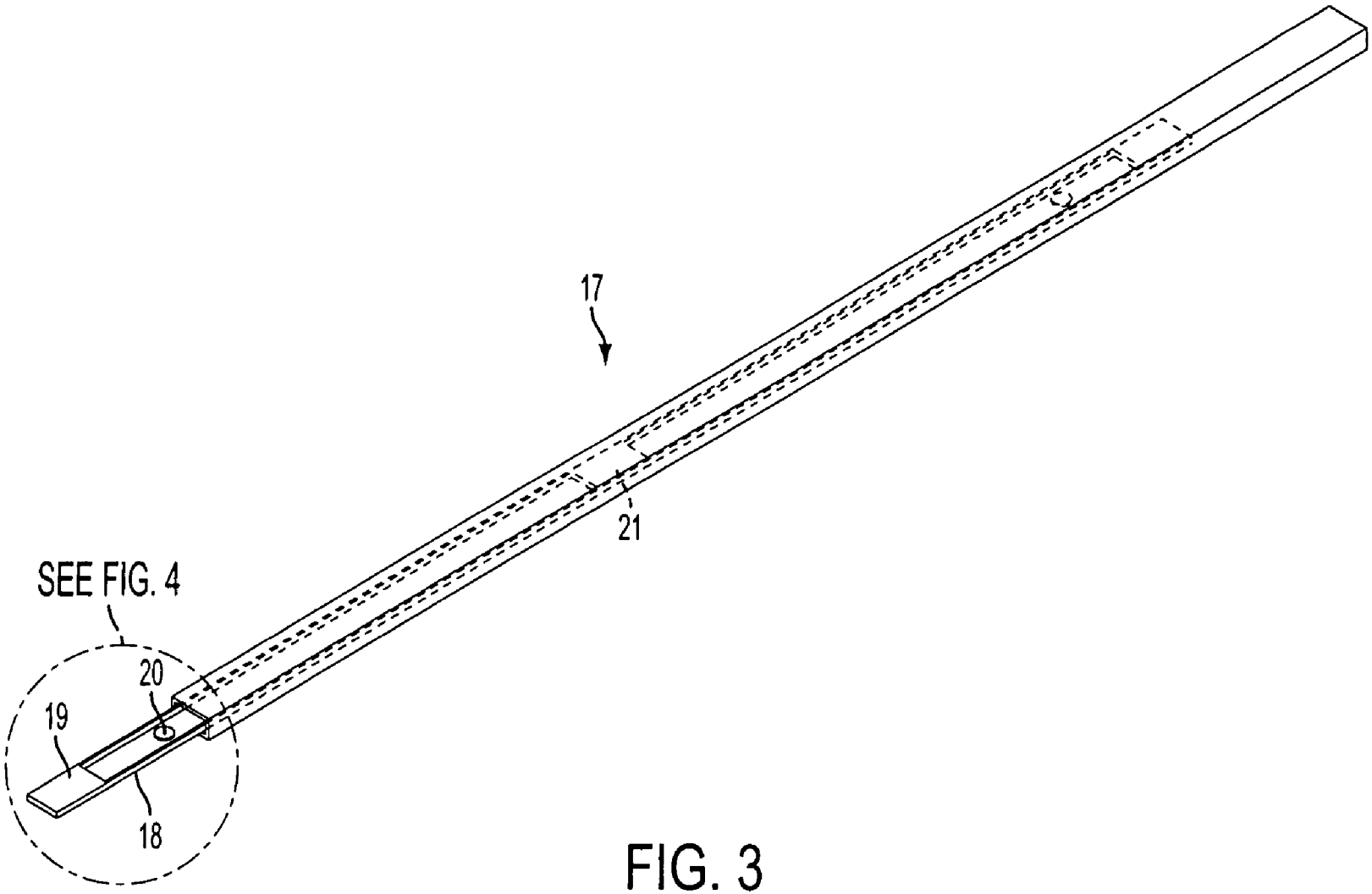
FIGS. 3 and 4 show a non-structural member that is incorporated in the pallet of FIG. 1, at four different locations.
Figure 4:
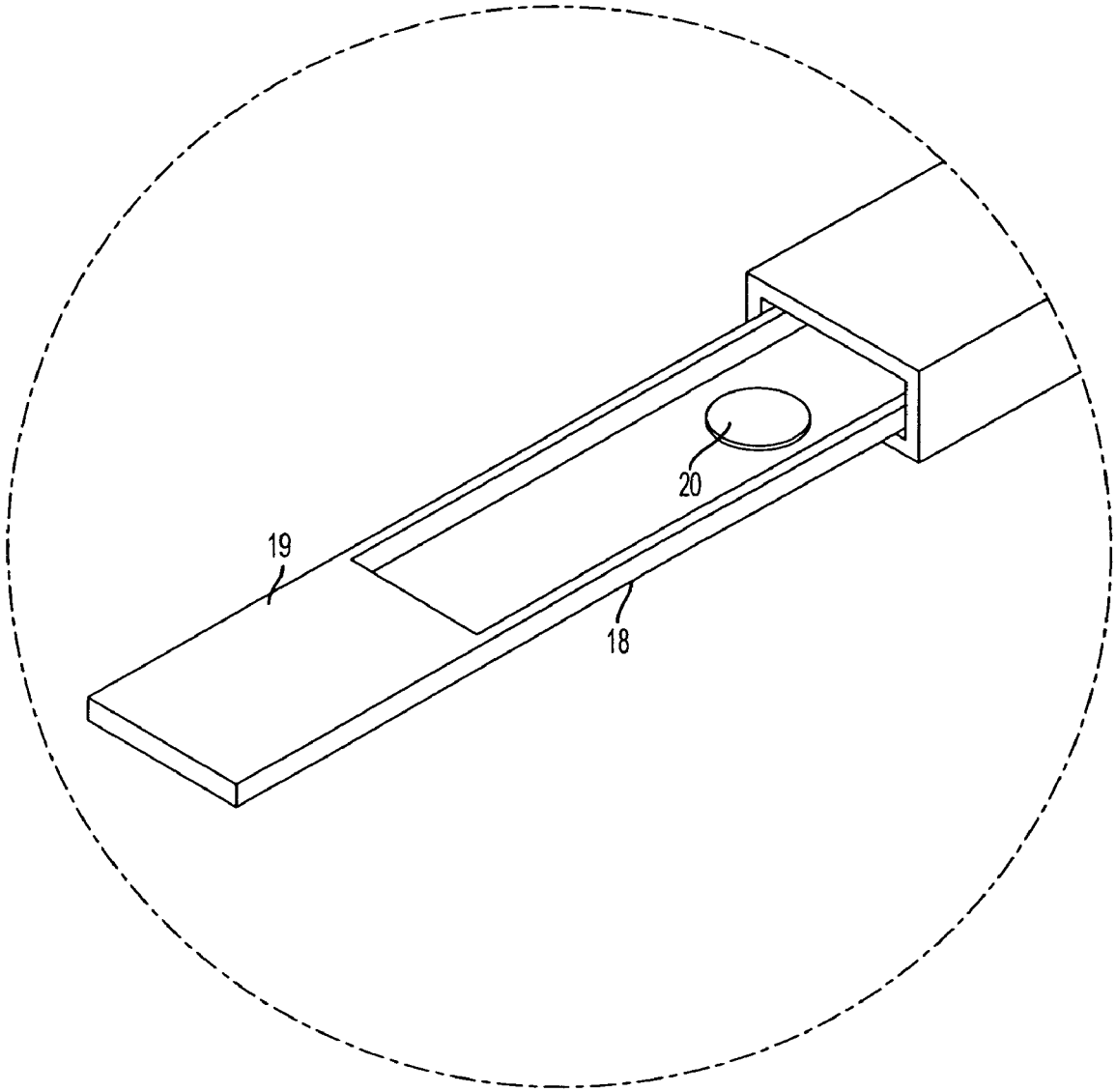

In FIGS. 3 and 4, sleeve-like non-structural member 17 is shown with contained drawer 18 partially pulled open. Drawer 18, which may be molded of any suitable plastic, has integral end plugs 19 at each end. Each end plug 19 extends far enough toward the interior of drawer 18 that when the drawer is closed, the end plug completely overlays stringer 15, at each end of non-structural member 17. While relatively snug-fitting, there is enough of a clearance between end plug 19 and the interior walls of the hollow sleeve to allow air to be forced out of non-structural member 17 as drawer 18 is inserted and pushed closed. Preferably non-structural member 17 and drawer 18 are made of the same weather-resistant plastic. In this particular embodiment, the walls of drawer 18 (where no plugs are present) are about 1 to 2 mm thick.

Before drawer 18 is inserted into non-structural member 17, two RFID tags 20 are adhered to the bottom of drawer 18, at locations that place each tag about 2 to 8 cm inboard of the outside stringer 15 at that end of the non-structural member, when the drawer is fully inserted therein. The tags are held in place by a contact adhesive (not shown). In all, eight RFID tags are installed in pallet 10, two in each of the four non-structural members 17.

Figure 5:
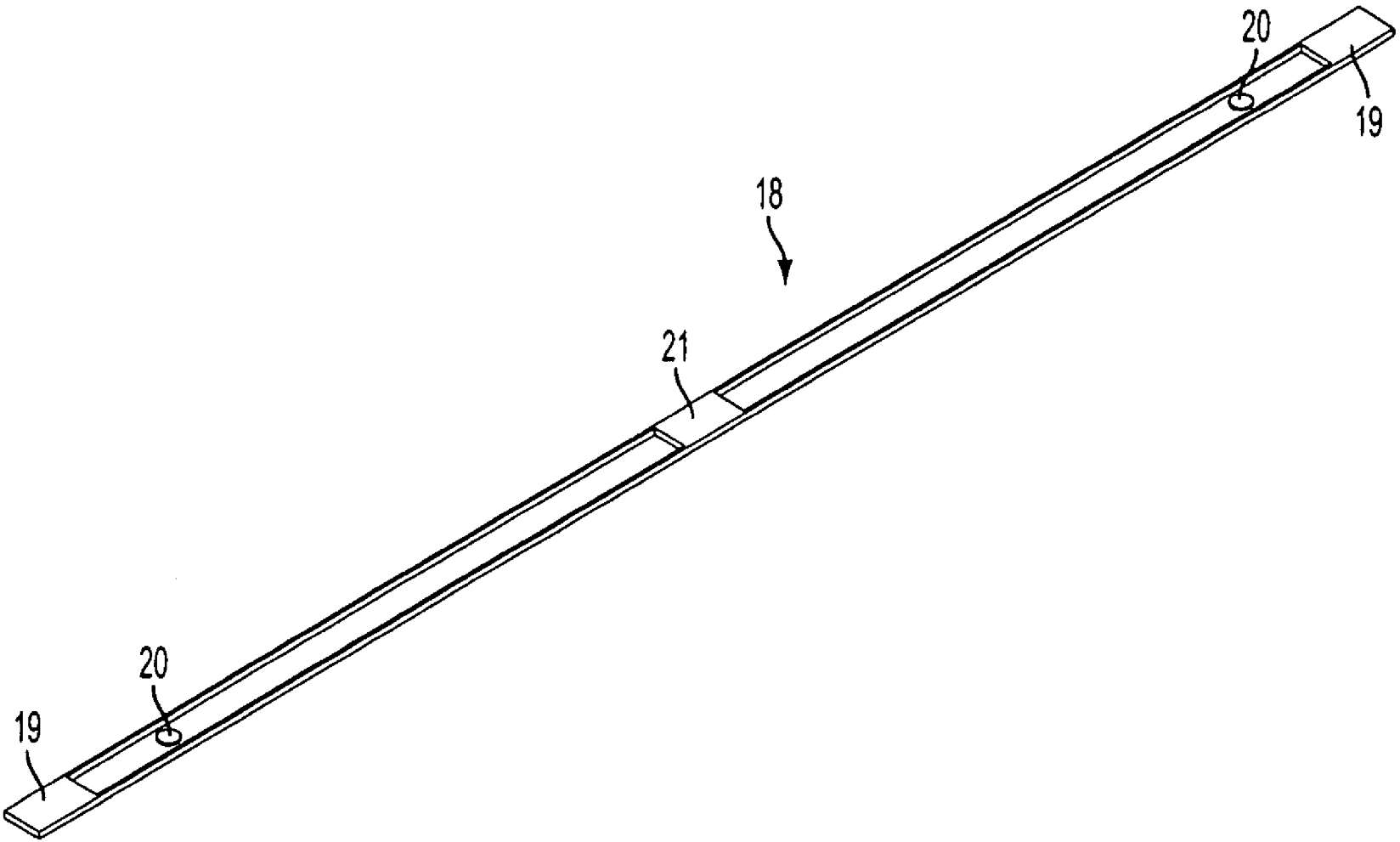
FIG. 5 shows the drawer portion of the non-structural member that is depicted in FIGS. 3 and 4.

In the center of drawer 18 is an interior plug 21 that is positioned above interior stringer 16 when drawer 18 is fully inserted in non-structural member 17. As best shown in FIG. 5, interior plug 21 is also integral with the rest of drawer 18—i.e., drawer 18, with its end plugs 19 and interior plug 21, is molded in one piece. End plugs 19 and interior plug 21 give non-structural member 17 enough rigidity at those three locations to allow it to be nailed to stringers 15 and 16—e.g., by a pneumatic nailing machine—without being damaged.

In the embodiment shown in FIG. 1, each non-structural member 17 is butted up against a front-edge board 11 or 13, so as to provide an extra measure of support for the front-edge board against blows from forklift tines or the like. Although non-structural member 17 and drawer 18 are relatively fragile (in comparison to the structural deck boards 11, 12, 13, and 14), because the non-structural members are nested between two structural deck boards and do not protrude out of their respective deck zones, the RFID tags inside the non-structural members are sheltered from any impact by forklift tines and the like. And because the RFID tags 20 are enclosed within a relatively thin plastic housing, they can easily be read by an RF interrogating unit that is above or below the flat-laying tags 20 as the pallet moves through an interrogation portal.

Turning to FIG. 2, the upper deck of the pallet 10 shown in that figure includes two half-length non-structural members 17. Each non-structural member 17 is nailed to outside stringer 15 and inside stringer 16 between each front-edge deck board 11 and the next-adjacent interior deck board 12.

Figure 6:
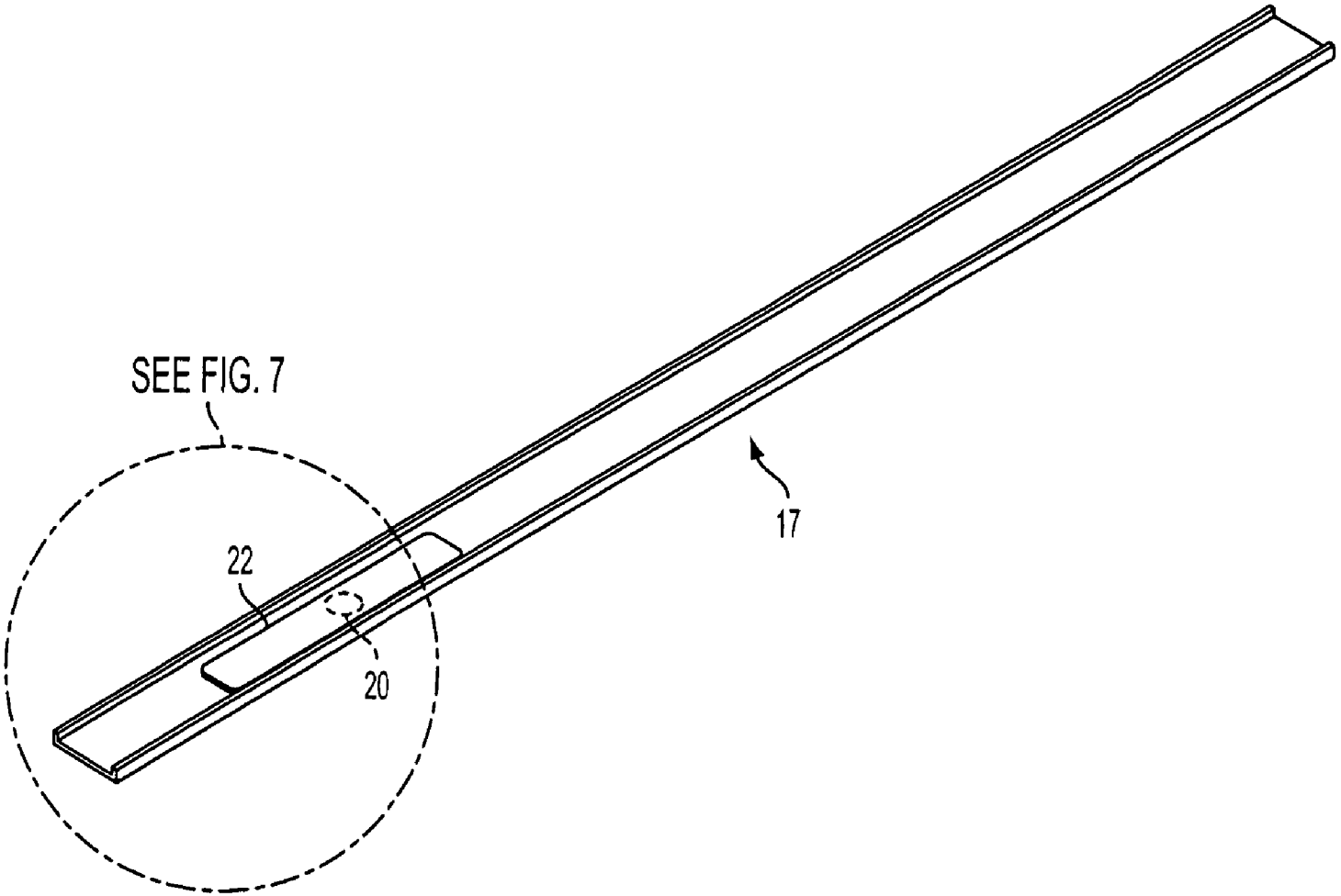
FIGS. 6 and 7 show a non-structural member that is incorporated in the pallet of FIG. 2, at two different locations.
Figure 7:
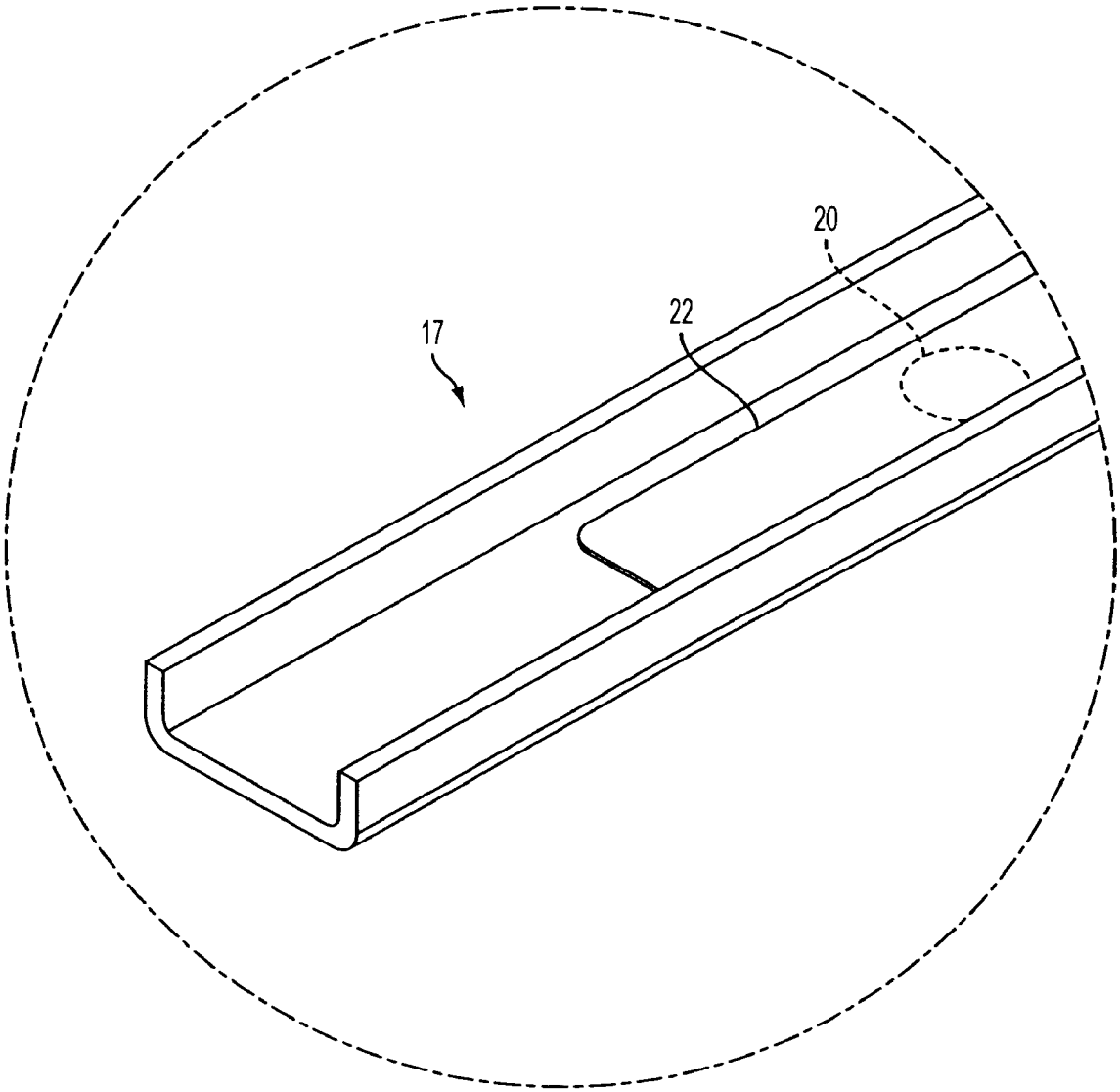

As shown in FIGS. 6 and 7, each half-length non-structural member 17 is a molded or extruded C-shaped channel. Each non-structural member 17 carries a readable device, in this case an RFID tag 20, which is secured to the bottom of the inside of the channel by an adhesive or the like. A thin plastic shield 22 is secured over the RFID tag 20. When non-structural member 17 has an open configuration, as shown in FIGS. 6 and 7, it is preferred that the open side of the non-structural member faces the interior of the pallet. An exception is if the non-structural member is mounted on the lower deck of the pallet, in which case it may be preferable to mount it so that the open side faces downward and away from the interior of the pallet so that liquids and debris do not collect inside the channel.

Figure 8:
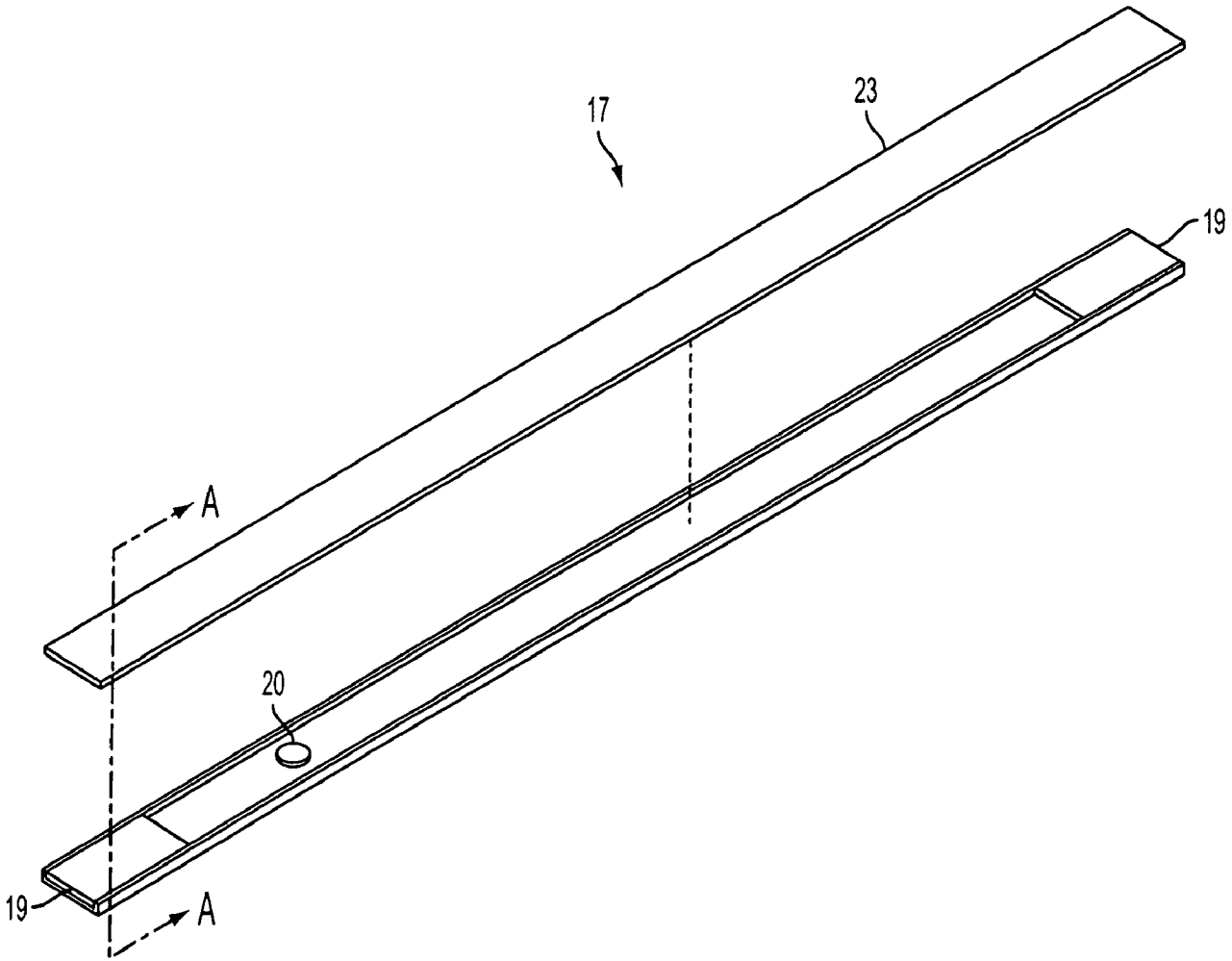
FIGS. 8 and 9 show an alternative embodiment of the non-structural member.
Figure 9:
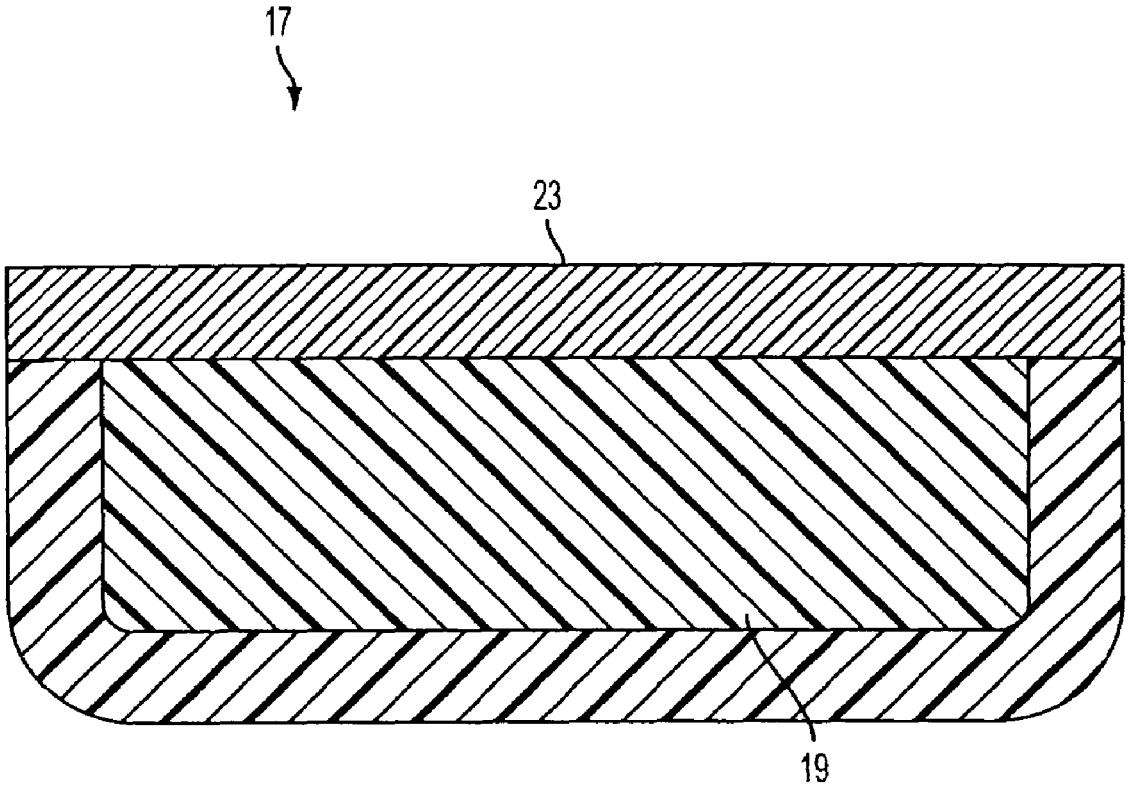

FIGS. 8 and 9 show a variation of the half-length non-structural member depicted in FIGS. 6 and 7. In FIGS. 8 and 9, the C-shaped channel is fitted at each end with end plugs 19, and the open side of the channel is closed by a cover 23, preferably one made of the same material and having the same wall thickness as the C-shaped channel. For illustration purposes, FIG. 8 shows cover 23 removed, while FIG. 9 (which depicts cross-section A-A in FIG. 8) shows the cover attached to the C-shaped channel.

Figure 10:
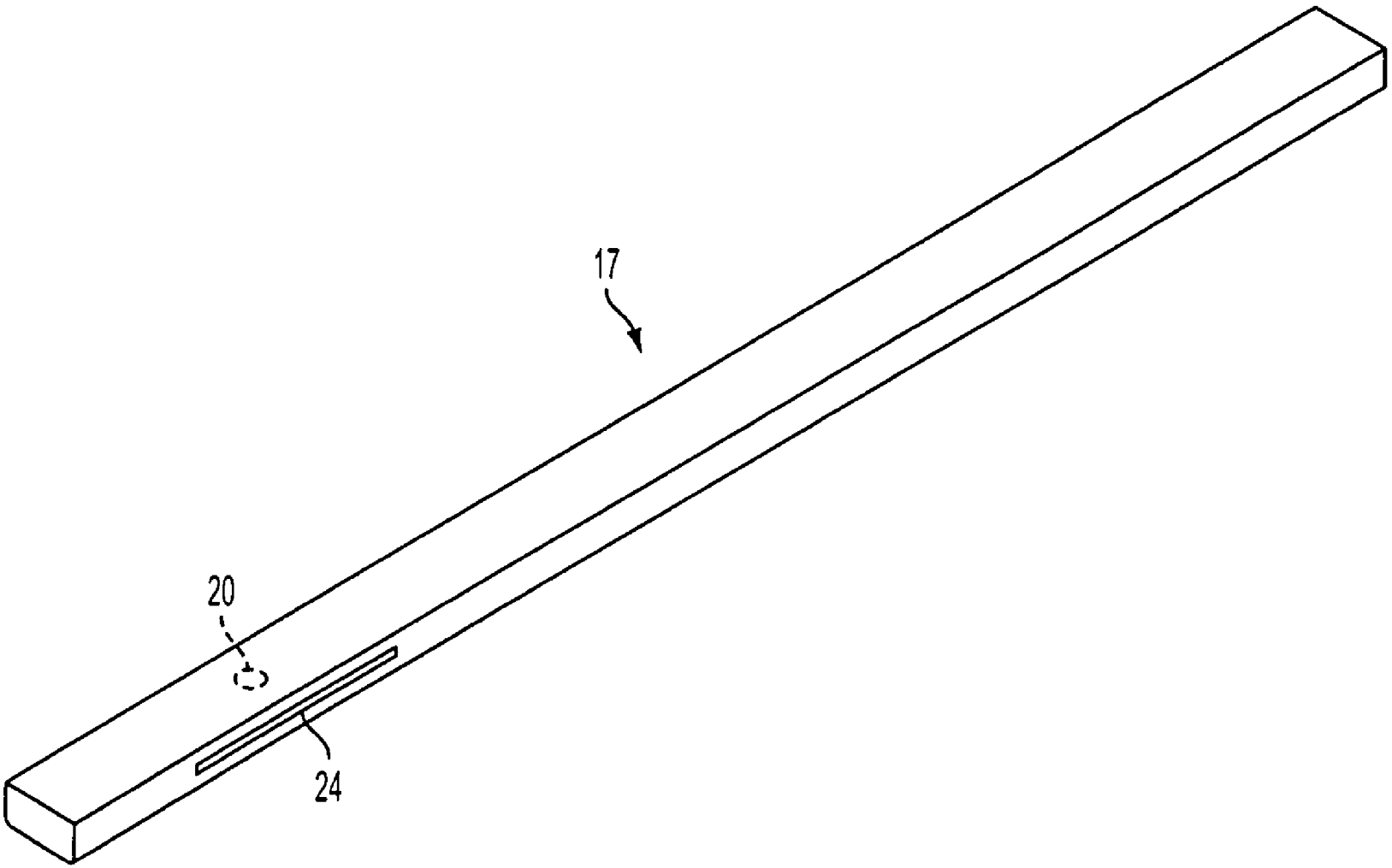
FIG. 10 shows another alternative embodiment of the non-structural member.

FIG. 10 shows still another variation of the non-structural member. In this embodiment, non-structural member 17 is formed as a solid length of plastic with a linear slot 24 formed in one of its long-side edges, wide enough and deep enough to hold, and completely envelop, RFID tag 20.

Figure 11:
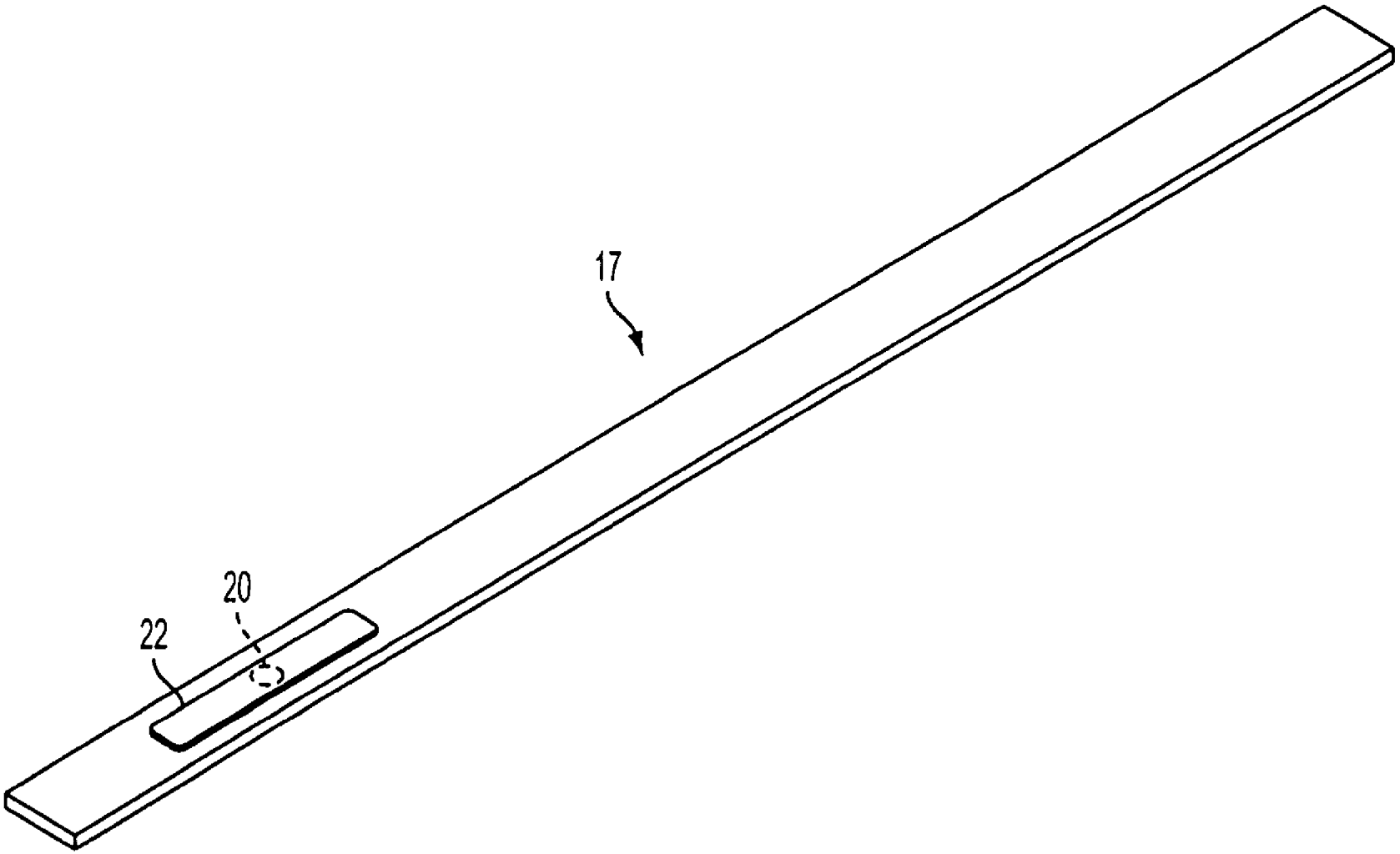
FIG. 11 shows still another alternative embodiment of the non-structural member.

FIG. 11 shows yet another variation of the non-structural member. In this embodiment, non-structural member 17 is a thin plastic strip, having a thickness of about 0.238 to 1.2 cm, and includes an RFID inlay 20. For added protection, a plastic shield 22 is secured over the area where RFID tag 20 is inlaid.

Although specific embodiments of the present invention have been described above in detail, it will be understood that this description is merely for purposes of illustration. Various modifications of and equivalent structures corresponding to the disclosed aspects of the preferred embodiments described above may be made by those skilled in the art without departing from the spirit of the present invention.

The invention claimed is:

1. In a shipping pallet comprised of at least one layer of substantially parallel, structural deck boards attached to a plurality of stringers, the layer of deck boards defining a three-dimensional, substantially rectilinear deck zone that is defined by a top plane, a bottom plane, and four side-edge planes, wherein the pallet is equipped with at least one readable device selected from the group consisting of radio frequency identification (RFID) tags, microprocessors, and sensors, the improvement wherein the readable device is carried by a non-structural member that is mounted within the deck zone between two structural deck boards, the non-structural member being of a size such that it is substantially entirely contained within the deck zone, and the non-structural member being made of RF-permeable material and having a Modulus of Elasticity and Modulus of Rupture that are both below that of the strongest deck board in the deck zone in which the non-structural member is mounted, wherein the non-structural member is elongated in shape, is mounted substantially parallel to the two structural deck boards that flank the non-structural member, and is of a sufficient length that it spans at least two stringers.

2. The shipping pallet of claim 1, wherein the non-structural member is substantially rectilinear, is substantially the same length as the structural deck boards, and is attached to at least two stringers.

3. The shipping pallet of claim 2, wherein the non-structural member is attached to the two outermost stringers of the pallet.

4. The shipping pallet of claim 1, wherein the non-structural member is substantially rectilinear, is approximately half the length of the structural deck boards, and is attached to at least two stringers.

5. The shipping pallet of claim 1, wherein the non-structural member is hollow.

6. The shipping pallet of claim 5, wherein the non-structural member has a C-shaped cross section.

7. The shipping pallet of claim 5, wherein each end of the non-structural member is plugged with a plug made of a substantially rigid material that reinforces the non-structural member.

8. The shipping pallet of claim 7, wherein each plug extends only part way into the non-structural member, but sufficiently far that it substantially overlaps the outermost stringer on that side of the pallet, and wherein the non-structural member is attached to the outermost stringers by fasteners that pass through the plugs.

9. The shipping pallet of claim 7, wherein the non-structural member has a closed cross section, and the cavity inside the non-structural member, between the plugs, is substantially filled with material that has a lower compression resistance than does the plug material.

10. The shipping pallet of claim 1, wherein the gap between the deck boards that flank the non-structural member is wider than all of the other gaps between adjacent deck boards in the deck zone.

11. The shipping pallet of claim 1, wherein the gap between the deck boards that flank the non-structural member is about 1.9 to 5.1 cm wide.

12. The shipping pallet of claim 1, wherein the non-structural member has a thickness that is less than that of each of the structural deck boards that flank the non-structural member.

13. The shipping pallet of claim 12, wherein the non-structural member is a substantially flat strip of material onto which the readable device is inlaid.

14. The shipping pallet of claim 1, wherein the non-structural member is a substantially non-hollow part having a slot therein, and the readable device is held in the slot.

15. The shipping pallet of claim 1, wherein the readable device is placed inside a drawer, and the drawer is slidable into and out of the non-structural member.

* * * * *